US011825937B1

(12) United States Patent
Ferrino

(10) Patent No.: US 11,825,937 B1
(45) Date of Patent: Nov. 28, 2023

(54) FREESTANDING SUPPORT STRUCTURE

(71) Applicant: Jesse Ferrino, North Wales, PA (US)

(72) Inventor: Jesse Ferrino, North Wales, PA (US)

( * ) Notice: Subject to any disclaimer, the term of this patent is extended or adjusted under 35 U.S.C. 154(b) by 0 days.

(21) Appl. No.: 17/697,155

(22) Filed: Mar. 17, 2022

Related U.S. Application Data

(60) Provisional application No. 63/164,730, filed on Mar. 23, 2021.

(51) Int. Cl.
*A47B 13/10* (2006.01)
*A47B 91/00* (2006.01)

(52) U.S. Cl.
CPC ..... *A47B 13/10* (2013.01); *A47B 91/005* (2013.01)

(58) Field of Classification Search
CPC ..... A47B 13/10; A47B 91/005
See application file for complete search history.

(56) References Cited

U.S. PATENT DOCUMENTS 3,057,591 A * 10/1962 Weimer ..... G10G 5/00 248/460
5,303,829 A * 4/1994 Kennedy ..... A47F 7/06 211/32
6,835,883 B2 * 12/2004 Stevens ..... F16M 11/22 84/327
7,118,172 B1 10/2006 Pattison-Sheets
D546,522 S 7/2007 Naujoks
7,374,144 B1 * 5/2008 Wonderling ..... A47B 97/08 248/463
7,819,247 B2 10/2010 Gonzalez
7,901,018 B2 3/2011 Baughman
8,181,760 B2 5/2012 Trieu
D693,570 S 11/2013 Rathburn
9,986,865 B2 6/2018 Morris
D846,321 S * 4/2019 Vandervorst ..... D6/682
10,932,563 B2 * 3/2021 Taylor ..... A47B 23/043
11,064,805 B1 * 7/2021 Berkin-Harper ..... A47B 13/04
D944,002 S * 2/2022 Hu ..... D3/204
11,234,546 B2 * 2/2022 Fierro, II ..... G09F 1/14
2014/0138499 A1 5/2014 Laitila et al.
(Continued)

OTHER PUBLICATIONS

Addio Design company Atlas backpack stand: https://www.addiodesign.com/ (Year: 2021).*

(Continued)

*Primary Examiner* — Terrell L McKinnon
*Assistant Examiner* — Ding Y Tan
(74) *Attorney, Agent, or Firm* — Joseph E. Maenner; Maenner & Associates, LLC

(57) ABSTRACT

A freestanding support structure includes a first leg member having a first base portion having a free end extending along a first base axis and a connected end and a first support portion extending upwardly from the connected end of the first base portion along a first support axis to a top end. A second leg member includes a second base portion having a free end extending along a second base axis and a connected end and a second support portion extending upwardly from the connected end of the second base portion along a second support axis to a top end. A base platform is connected to the free end of the first base portion and to the free end of the second base portion and a top platform is connected to the top end of the first support portion and to the top end of the second support portion.

17 Claims, 11 Drawing Sheets

(56) References Cited

U.S. PATENT DOCUMENTS

| | | | | |
|---|---|---|---|---|
| 2017/0114813 | A1* | 4/2017 | Brown | F16B 12/125 |
| 2017/0114947 | A1* | 4/2017 | Max | G10H 1/32 |
| 2018/0035799 | A1* | 2/2018 | Leafgren | A47B 13/04 |
| 2020/0191533 | A1* | 6/2020 | Lovell, III | F41J 1/10 |
| 2020/0315324 | A1* | 10/2020 | Fox | A45D 19/00 |
| 2021/0030181 | A1* | 2/2021 | Wobig | A47G 25/0685 |
| 2021/0037663 | A1* | 2/2021 | Davidson | A47B 21/04 |

OTHER PUBLICATIONS

Display2go workshop acrylic holder SKU MH1PKTKDCL dated Aug. 25, 2017 by web.archive.org, webpage https://www.displays2go.com/P-33746/Knock-Down-Magazine-Holder-Clear-Acrylic-Panels (Year: 2017).*

Scotch felt furniture pad sold on amazon dated Dec. 5, 2017 162 PCS Furniture pads (Year: 2017).*

Display2go black bi-fold adjustable wood free-standing display easel sold on amazon dated Oct. 15, 2012 (Year: 2012).*

Take a stand guitar stand SM design guitar stand product webpage dated Mar. 18, 2019 by web.archive.org, https://takeastandinc.com/ (Year: 2019).*

3×3custom Tamar youtube video dated Feb. 14, 2020 https://www.youtube.com/watch?v=fo8nD9bT3bM (Year: 2020).*

Fine power tools online article dated Jul. 12, 2020 by Dan Miller: 15 types of wood joints https://www.finepowertools.com/woodworking/wood-joint-types/ (Year: 2020).*

Bamboo charging station for multiple devices sold on amazon dated Aug. 2, 2019, https://www.amazon.com/Charging-Pezin-Hulin-Electronic-Organizer/dp/B07W136QTV (Year: 2019).*

Labobbon wireless charger station sold on amazon.com dated Aug. 5, 2019 (Year: 2020).* https://www.gophersport.com/sports/golf/stand-up-golf-bags?item=3500. Printed Jun. 27, 2022. 4 pages.

https://www.clevrcarriers.com/products/clevr-canyonero-baby-backpack-child-kid-baby-carrier-cross-country-hiking-red. Printed Jun. 27, 2022. 5 pages.

https://www.standupdeskstore.com/clamp-on-under-desk-headphone-holder-backpack-hook-purse-hook?gclid=Cj0KCQiArvX_BRCyARIsAKsnTxNL8Dm79sq7TOBnfzpSDjBKgKL3mQHgAkAxvprxMZoBWxwUIB3HhagaAn_EALw_wcB. Printed Jun. 27, 2022. 8 pages.

https://saffordtrading.com/shop/archery/bow-accessories/quivers/tightspot-5-arrow-quiver-rh-tsq5red-r/?gclid=Cj0KCQiArvX_BRCyARIsAKsnTxPRotzBJyzpozMZ0Kj3GnB1ohi0SOKJY4T6RR4Cxr5YElpQRmFtwP8aAuViEALw_wCB. Printed Jun. 27, 2022. 4 pages.

https://www.scheels.com/p/beard-buster-ground-and-poundchair/72656701567.html?pgid=psearch&src=hardlines&srsltid=AfmBOoqF8JqzgWyZnLuISEKuD7Fm9EzRHHrifg5g7VGIw1_XQepvm9ULMY&utm_campaign=unpaidlistings&utm_medium=cpc&utm_source=google.

https://www.etsy.com/listing/768236348/ruck-rack-20.

* cited by examiner

FREESTANDING SUPPORT STRUCTURE

CROSS-REFERENCE TO RELATED APPLICATION

The present application claims the benefit of U.S. Provisional Patent Application Ser. No. 63/164,730, filed on Mar. 23, 2021, which is incorporated herein by reference in its entirety.

BACKGROUND OF THE INVENTION

Field of the Invention

The invention relates to a freestanding support structure that is configured to hold and support a plurality of cords, coats, bags and other belongings.

Description of the Related Art

Coat hangers, coat hooks, coat racks, shelves, and carrying storage systems are well known in the art and exhibit a broad range of features related to carrying, storage capability, and functionality. Current coat hanging systems, or shelving racks, or work surfaces have generally proven satisfactory and have not needed much change or problem solving over the years. However, these items are limited by their functionality and capability, and applications for specific environments.

Fixed wall coat hooks function for holding coats, purses, and other personal items away from the item' user. However, a coat rack or the like is generally very limited in its functionality. For example, coat hangers are limited to, holding items with straps or long coats that have hooks or can be folded over.

Shelving or similar coat hanger racks are limited in the type of items they can support. For example, shelving is generally flat and can only support items which fit on flat surfaces easily. In this way, a shelf or shelving system lacks any special functionality or capabilities. Similarly, a service tray or seat back might be one item found for use which can fold down and be readily available. However, this item is generally limited to airplane use as it must be found on the back of a seat or the like.

Oftentimes in public, personal purses, backpack, and briefcases and other personal belongings tend to get strewn about. This can occur in a home, an office, a coffee shop, a bookstore, a classroom, a library, a conference room, and the like. These spaces are generally ill-equipped for handling storage of various coats, cords, hats, gloves, bags, purses, and the like.

For this reason, seats are taken from restaurant owners, spaces are occupied in coffee shops, and dining room tables can't be used because of spaces, surfaces, or messes being made on various surfaces through storage of cords, coats, bags and other belongings. Similarly, a coffee shop owner, restaurant owner, homeowner, or office manager must get storage racks in or out depending on the time of the year, or fail to solve the problems all together. Similarly, if someone hangs a bag or backpack up on known coat hangers, they are not able to access the belongings without getting up and moving about. In this way, a user cannot access the contents of stored materials. Furthermore, sometimes these contents must be stored away from a user and this can create a theft or lost article issue.

It would be beneficial to provide a single structure that can support and store a plurality of cords, coats, bags and other belongings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a freestanding support structure that includes a first leg member having a first base portion having a free end extending along a first base axis and a connected end and a first support portion extending upwardly from the connected end of the first base portion along a first support axis to a top end. A second leg member includes a second base portion having a free end extending along a second base axis and a connected end and a second support portion extending upwardly from the connected end of the second base portion along a second support axis to a top end. A base platform is connected to the free end of the first base portion and to the free end of the second base portion and a top platform is connected to the top end of the first support portion and to the top end of the second support portion.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
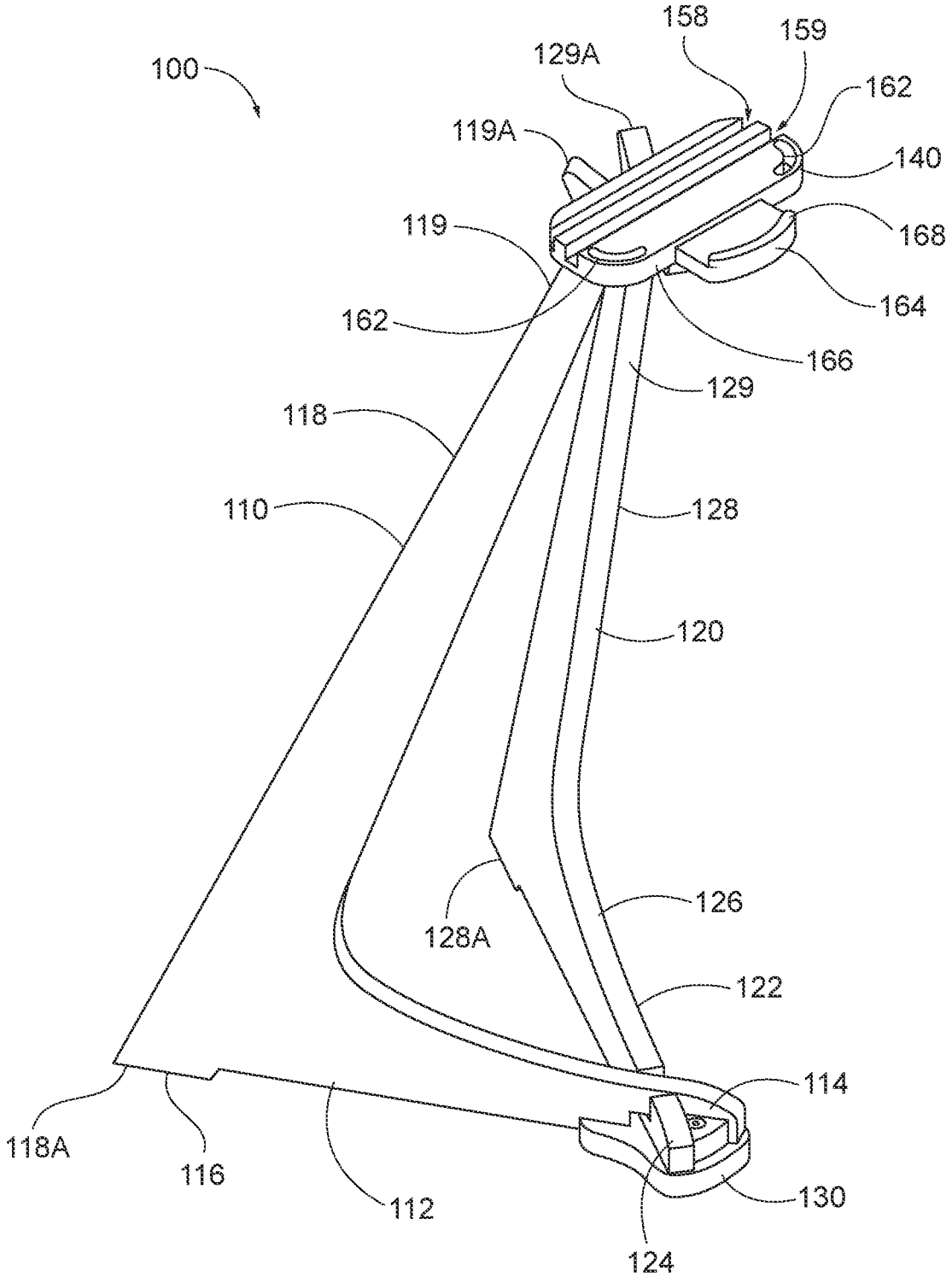
FIG. 1 is a perspective view of a freestanding support structure according to an exemplary embodiment of the present invention.
Figure 2:
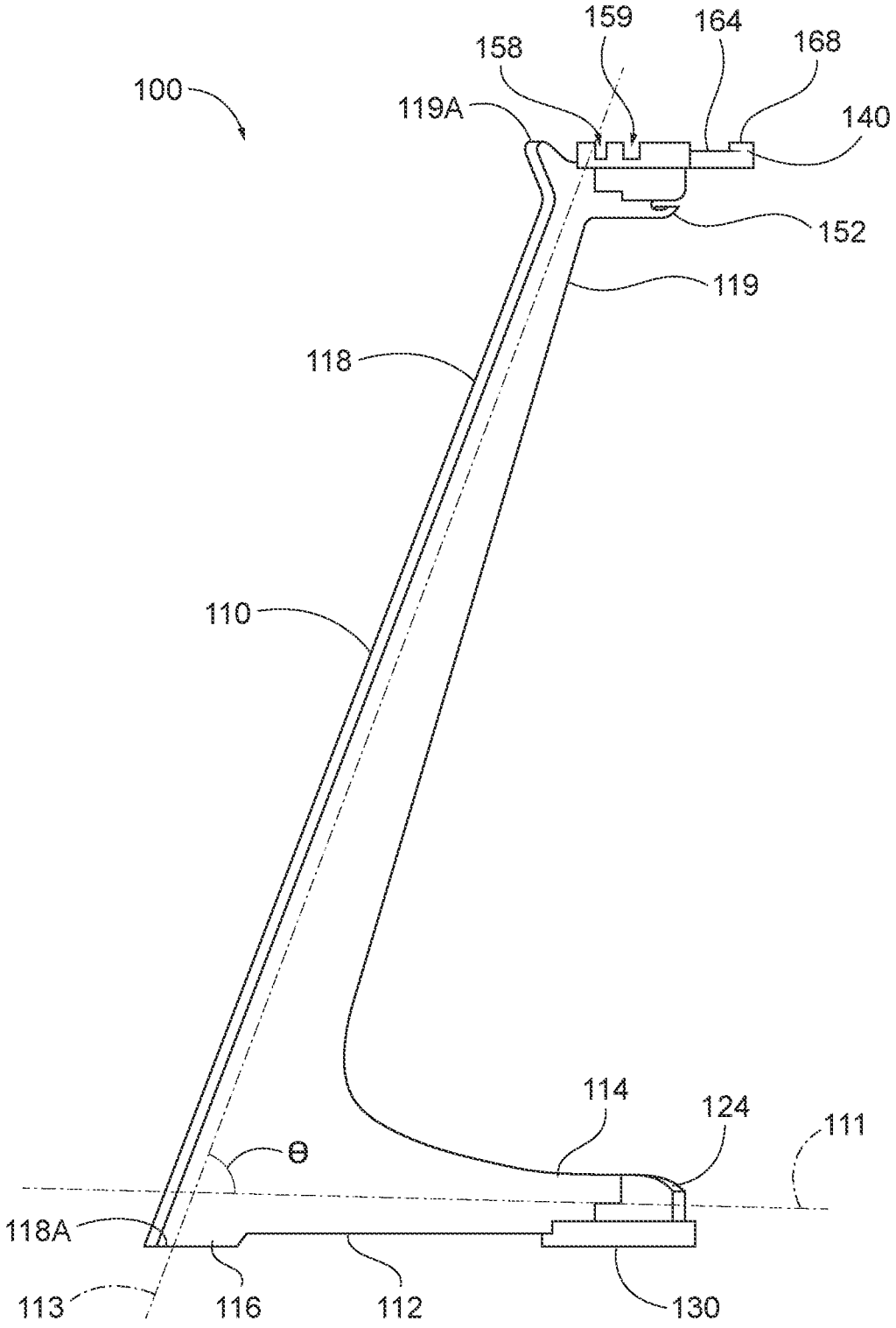
FIG. 2 is a left side elevational view of the structure of FIG. 1.
Figure 3:
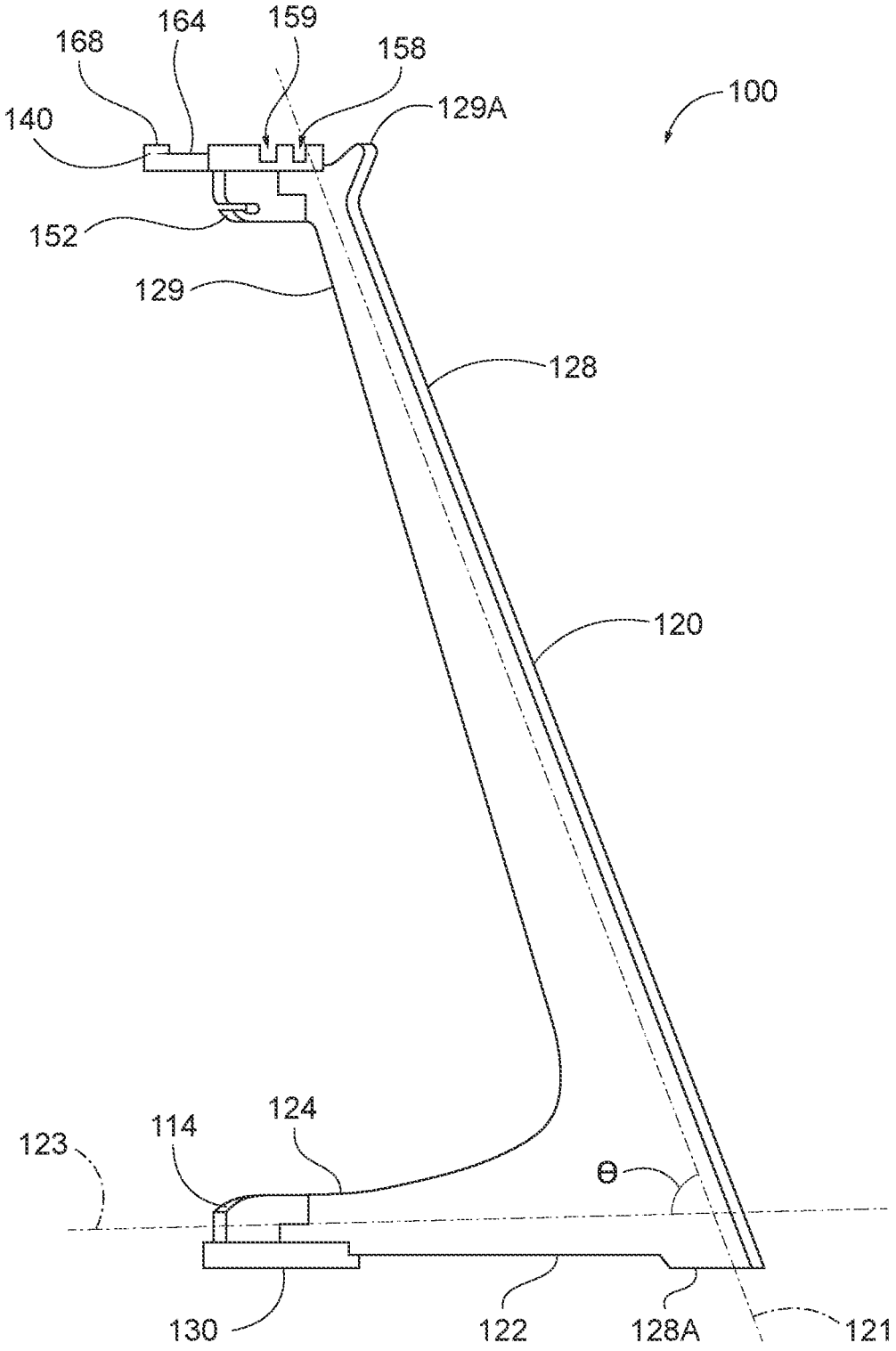
FIG. 3 is a right side elevational view of the structure of FIG. 1.
Figure 4:
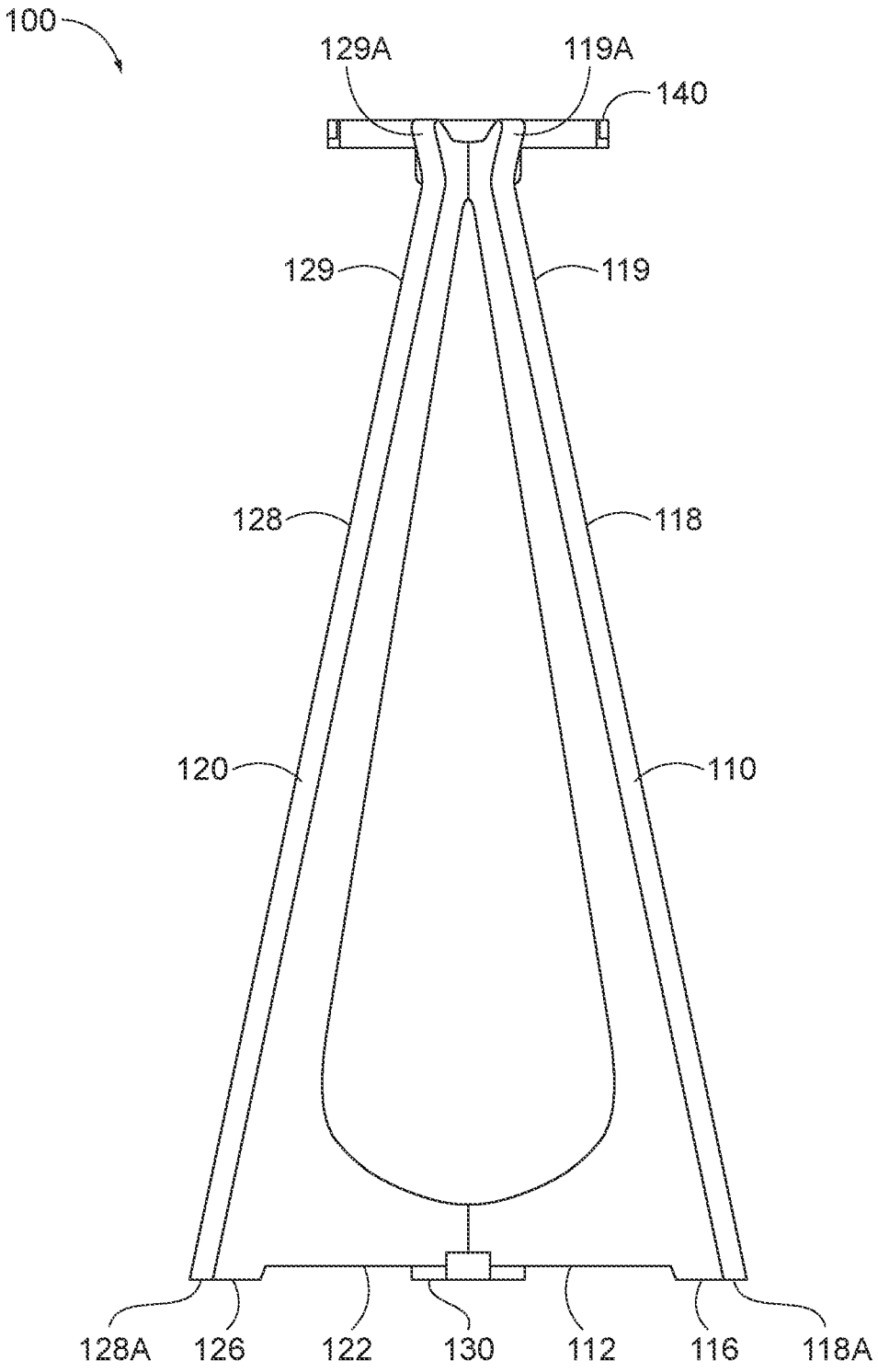
FIG. 4 is a front elevational view of the structure of FIG. 1.
Figure 5:
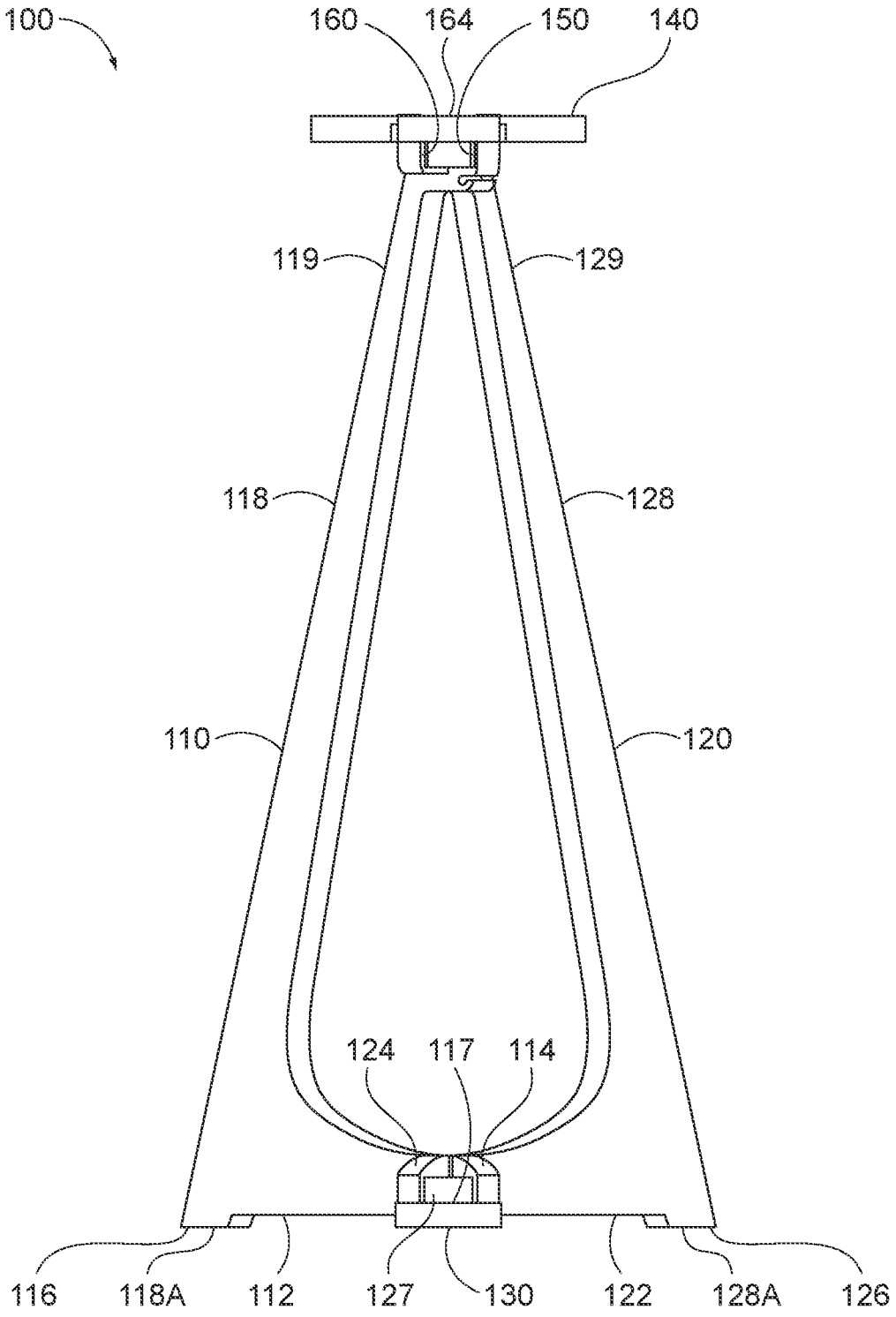
FIG. 5 is a rear elevational view of the structure of FIG. 1.
Figure 6:
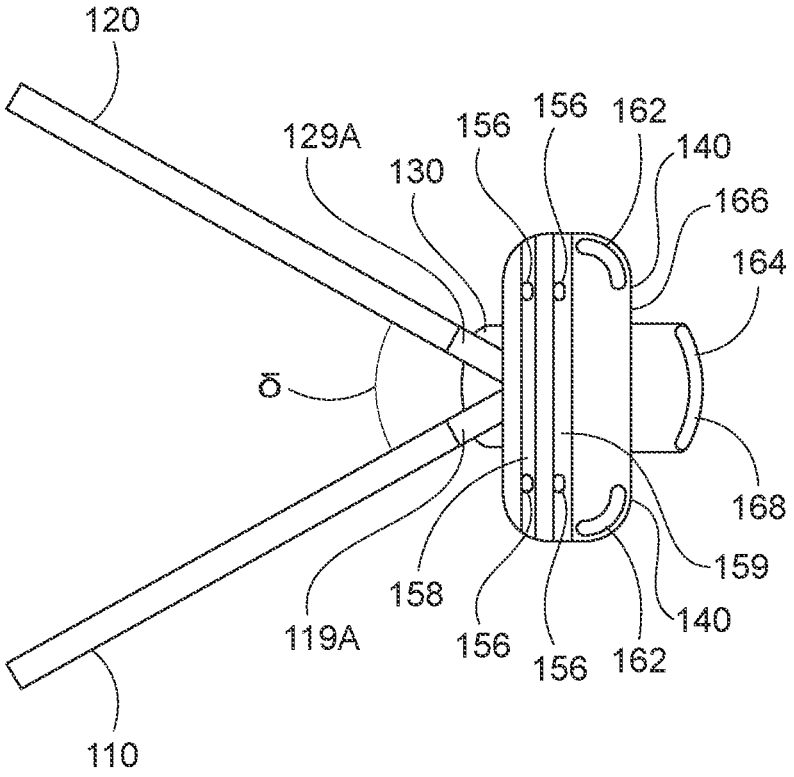
FIG. 6 is a top plan view of the structure of FIG. 1.
Figure 7:
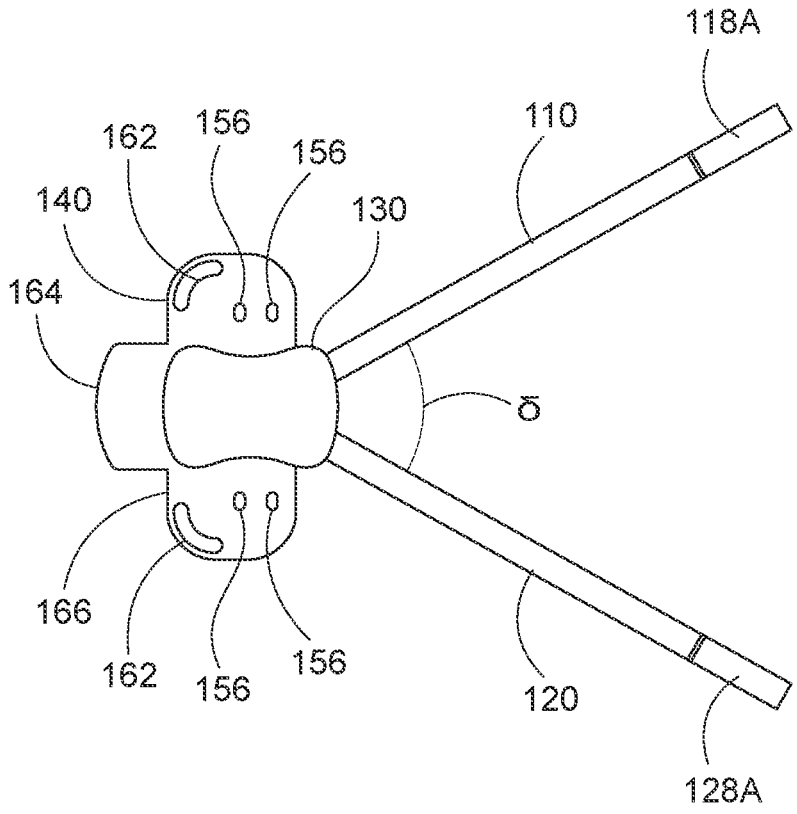
FIG. 7 is a bottom plan view of the structure of FIG. 1.
Figure 8:
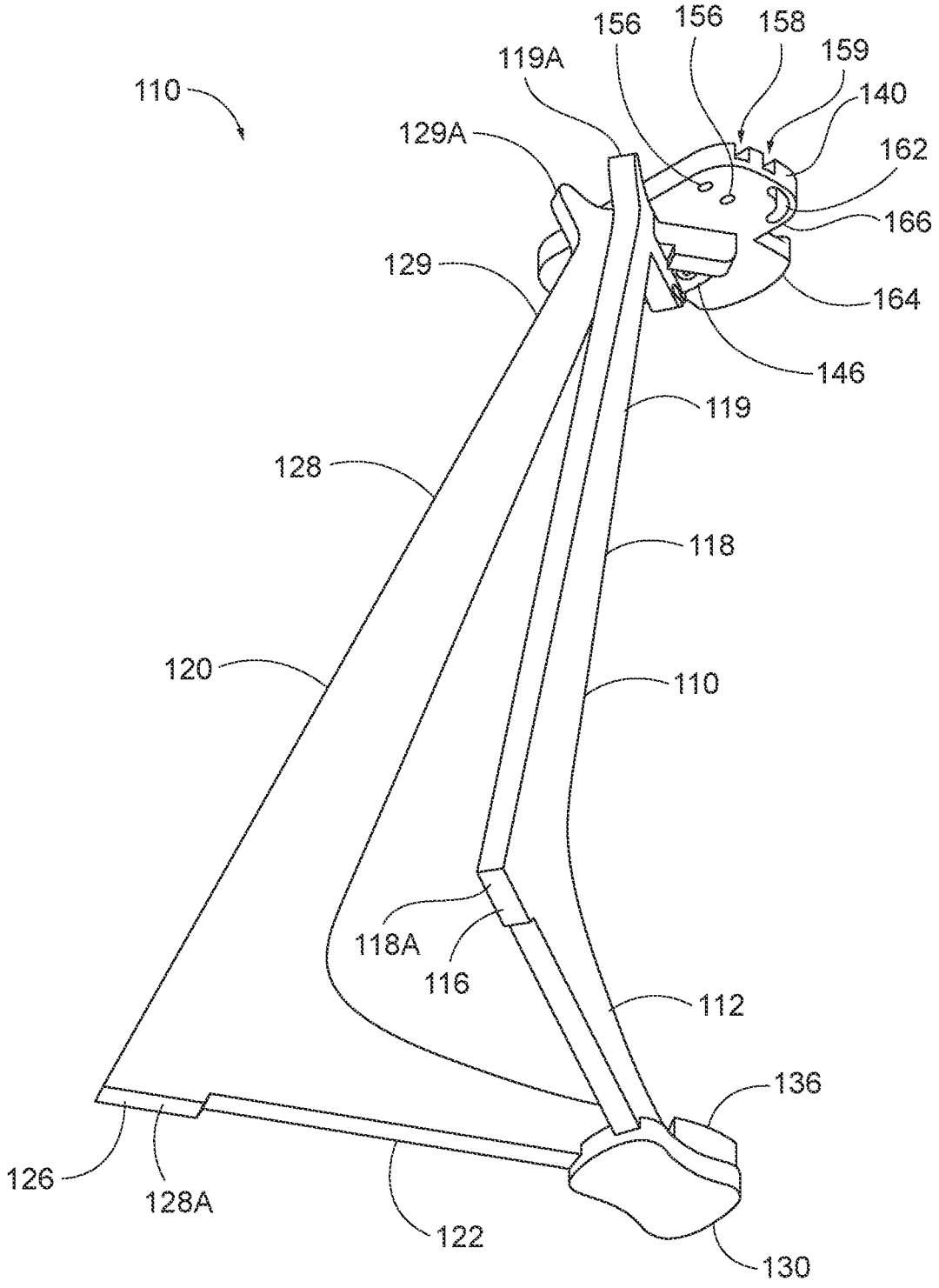
FIG. 8 is a bottom perspective view of the structure of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

A freestanding support structure 100 ("support 100") according to an exemplary embodiment of the present invention is designed and constructed to support various types of bags, backpacks, purses, electronic devices, gloves, hats, scarves, sunglasses, headphones, charging cords, and various other accessories. In an exemplary embodiment, support 100 Throughout the disclosure herein, the term "bag" or "backpack" is used for ease. This might be a common use, as a user desires to access contents within a bag and/or backpack with ease. Support 100 is designed to provide ease of access to a person's belongings and the like, in this way. In an exemplary embodiment, support 100 has a vertical height of about 32 inches, although those skilled in the art will recognize that support 100 can be other heights as well.

Referring to FIGS. 1-8, support 100 includes a first leg member 110 having a first base portion 112 such that first base member 112 has a free end 114 extending along a first base axis 111 and a connected end 116. A first support portion 118 extends upwardly from the connected end 116 of the first base portion 112 along a first support axis 113 to a top end 119. First support portion 118 includes a forward floor pad 118A at the connection of first support portion 118 and connected end 112 of first base portion 112.

First base axis 111 extends at an oblique angle 8 relative to the first support axis 113. In an exemplary embodiment, angle 8 can be about 15 degrees, although those skilled in the art will recognize that angle 8 can be other than 15 degrees.

Similarly, a second leg member 120 has a second base portion 122 such that second base member 120 has a free end 124 extending along a second base axis 121 and a connected end 126. A second support portion 128 extends upwardly from the connected end 126 of the second base portion 122 along a second support axis 123 to a top end 129. Second support portion 128 includes a forward floor pad 128A at the connection of second support portion 128 and connected end 122 of second base portion 122.

Second base axis 121 extends at an oblique angle 8 relative to the second support axis 123. In an exemplary embodiment, angle 8 can be about 15 degrees, although those skilled in the art will recognize that angle 8 can be other than 15 degrees.

A base platform 130 is releasably connected to the free end 114 of the first base portion 112 and to the free end 124 of the second base portion 122. A top platform 140 is releasably connected to the top end 119 of the first support portion 118 and to the top end 129 of the second support portion 128. Top platform 140 is disposed vertically above the base platform 130. This arrangement, along with the 15 degree exemplary angle 8, provides a stable support 100.

Figure 9:
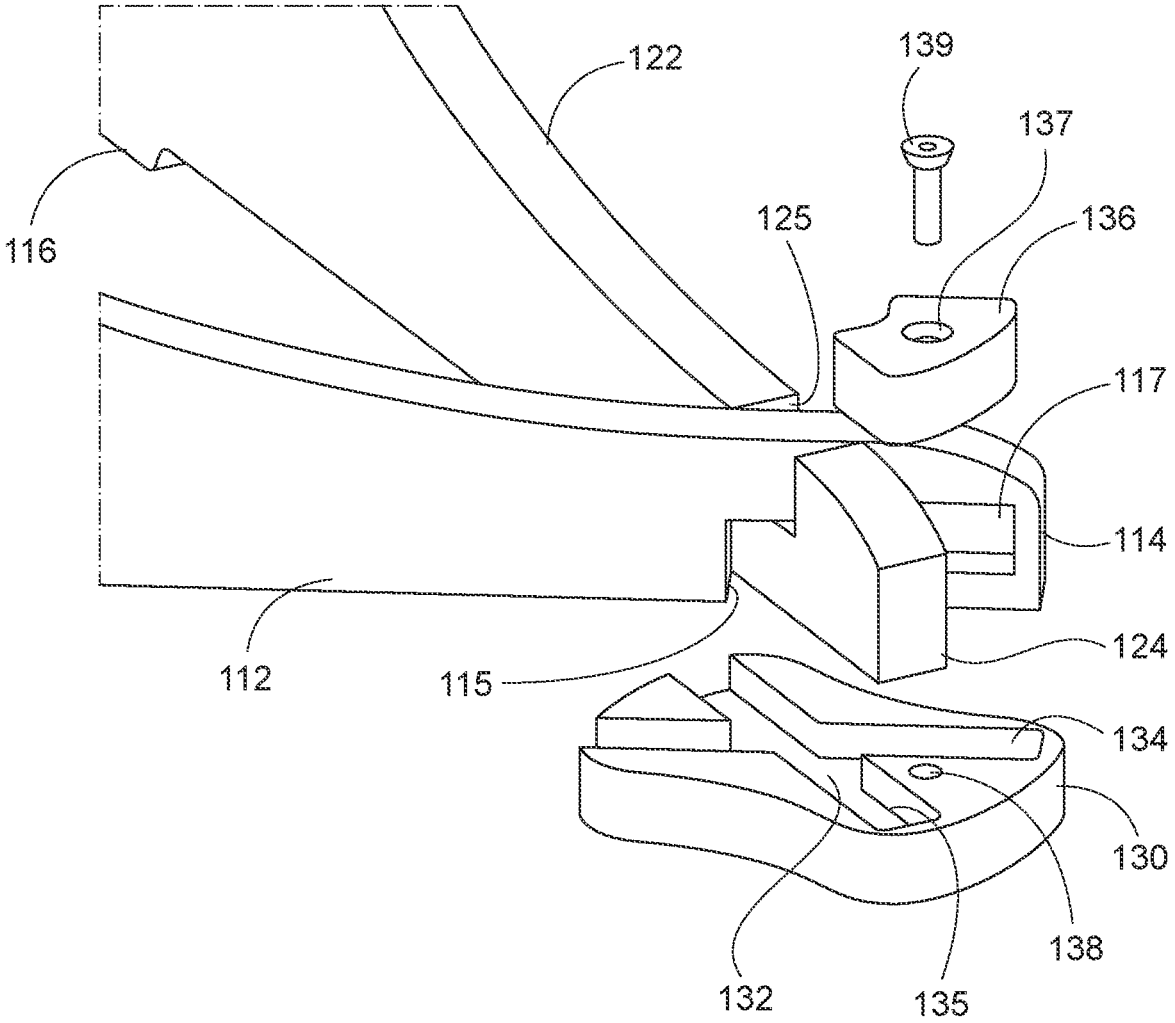
FIG. 9 is an exploded perspective view of a base connection for the structure of FIG. 1.

Base platform 130 and free ends 114, 124 of first base portion 112 and second base portion 122, respectively, are releasably secured together to form a stable base. As shown in FIG. 9, free end 114 of first base portion 112 has a first cutout 115 in the bottom of free end 114 that interlocks with a complementary cutout 125 in the top of free end 124 of second base portion 122. Base platform 130 includes an "X-shaped" cutout 132, wherein the free end 114 of the first base portion 112 is inserted into a first leg 134 of the "X" and wherein the free end 124 of the second base potion 122 is inserted into a remaining leg 135 of the "X".

Additionally, the free end 114, 124 of each of the first base portion 112 and the second base portion 122, respectively, has a blind passage 117, 127 (identified in FIG. 5) formed therein so that a lower spacer block 136 can be inserted into the blind passage 117, 127 in each of the first base portion 112 and the second base portion 124.

An unthreaded through passage 137 is formed in lower spacer block 136 that mates with a threaded blind passage 138 formed in base platform 130. A securing member, such as a screw 139, is removably insertable through the through passage 137 and into blind passage 138 where screw 139 threads into threaded blind passage 138 to secure lower spacer block 136, as well as free ends 114, 124 of first and second base portions 112, 122 to base platform 130. A top portion of through passage 137 can be chamfered so that the head of screw 139 does not protrude above the top of lower spacer block 136.

Figure 10:
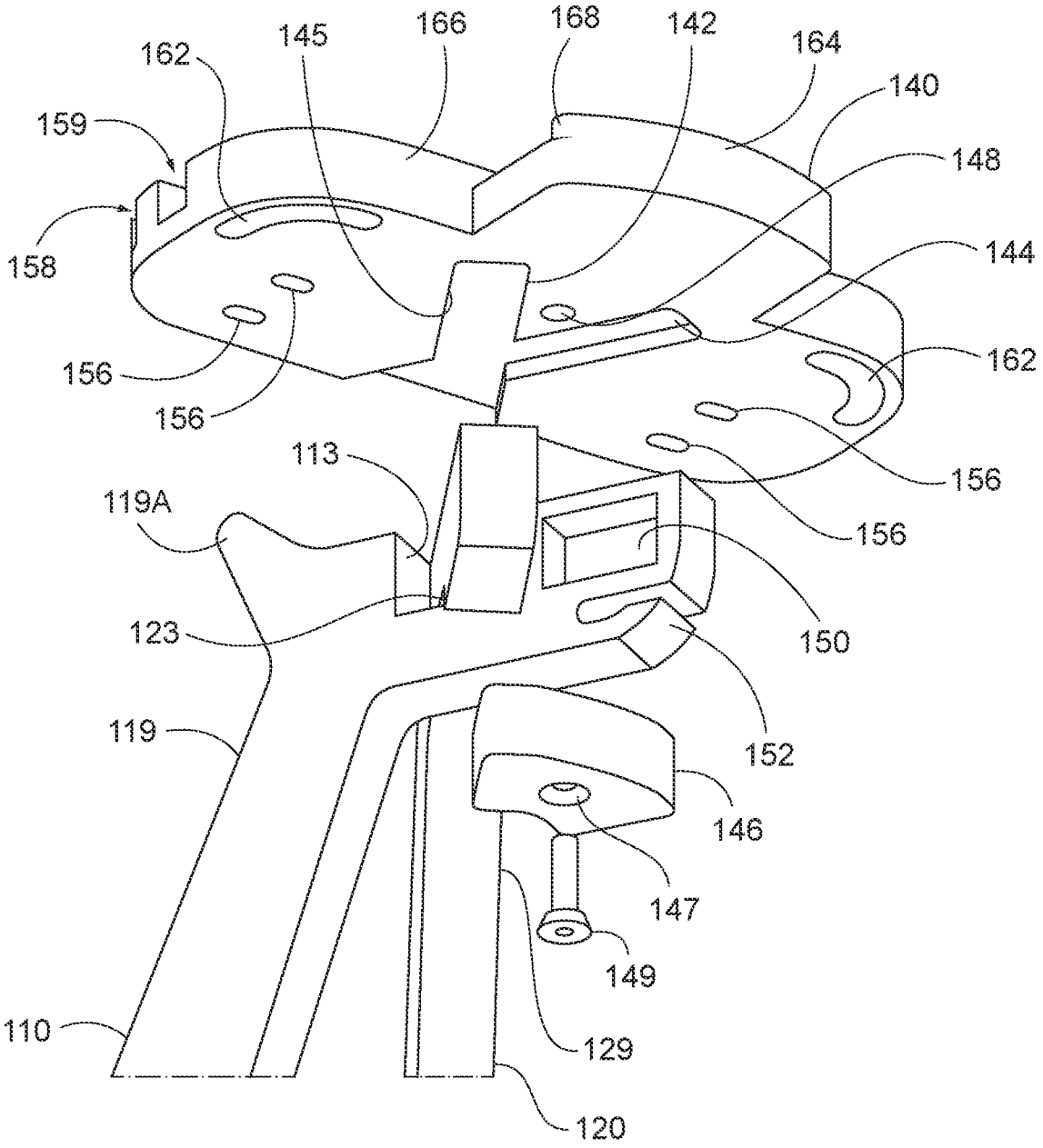
FIG. 10 is an exploded perspective view of a platform connection for the structure of FIG. 1.

Referring now to FIG. 10, similar to base portion 130, and free ends 114, 124 of first base portion 112 and second base portion 122, respectively, top platform 140 and top ends 119, 129 of first base portion 110 and second base portion 120 are releasably secured together to form a stable base. Top ends 119, 129 each also include a prong 119A, 129A, respectively, that form a retainer that can be used to support a bag, such as bag 50 shown in FIG. 11.

Top end 119 of first support portion 118 has a first cutout 113 in the top of top end 119 that interlocks with a complementary cutout 123 in the top of top end 129 of second support portion 129. Top platform 140 includes an "Y-shaped" cutout 142, wherein the top end 119 of the first support portion 118 is inserted into a first arm 144 of the "Y" and wherein the top end 129 of the second support potion 128 is inserted into a remaining arm 145 of the "Y".

Additionally, the top end 119, 129 of each of the first support portion 118 and the second support portion 128, respectively, has a blind passage 150, 160 (identified in FIG. 5) formed therein so that an upper spacer block 146 can be inserted into the blind passage 150, 160 in each of the first support portion 118 and the second support portion 128.

An unthreaded through passage 147 is formed in upper spacer block 146 that mates with a threaded blind passage 148 formed in top platform 140. A securing member, such as a screw 149, is removably insertable through the through passage 147 and into blind passage 148 where screw 149 threads into threaded blind passage 148 to secure upper spacer block 146, as well as top ends 119, 129 of first and second top portions 118, 128 to top platform 140. A bottom portion of through passage 147 can be chamfered so that the head of screw 149 does not protrude below the bottom of top spacer block 146.

Top end 119 of the first support portion 118 also has a support hook 152 formed therein. Support hook 152 can be used to support an electrical cable (not shown), such as for charging an electrical device (not shown). Hook 152 can also be used for storing headphones, for hanging coats and jackets, for secondary backpack hanging, other enhancements for compact storage, or access apertures for wire charging cords for mobile devices such as smartphones or tablets.

Top platform 140 also has a plurality of through-openings 156 formed therein. Through-openings 156 are sized and shaped to allow an electrical cable, such as for charging an electrical device, to pass through. Top platform 140 also has a first slot 158 formed therein and a second slot 159, parallel to the first slot 158, formed therein such that at least some of the plurality of through-openings 156 terminate in the first slot 158 and wherein at least others of the plurality of through-openings 156 terminate in the second slot 159. Slots 158, 159 can be formed of varying sizes, shape, and design so as to support—in a functional manner—other devices such as smartphones and tablets, as shown in some examples. Furthermore, in the arrangement shown, as one example, slots 158, 159 can be varying size and depths to accommodate the thicknesses of varying devices. Similarly, and in the arrangement shown, as one example, slots 158, 159 provide for freestanding smartphone and/or tablet functionality for which a user can interact with the device while the device is engaged with support 100. A user can interact with a smartphone or other device while the device is within one of slots 158, 159 so that the user can enhance zoom, utilize for video conferencing, engage in team meetings, activate face ID, activate fingerprint recognition, among other interactions with smartphone devices, tablets, and the like.

Figure 11:
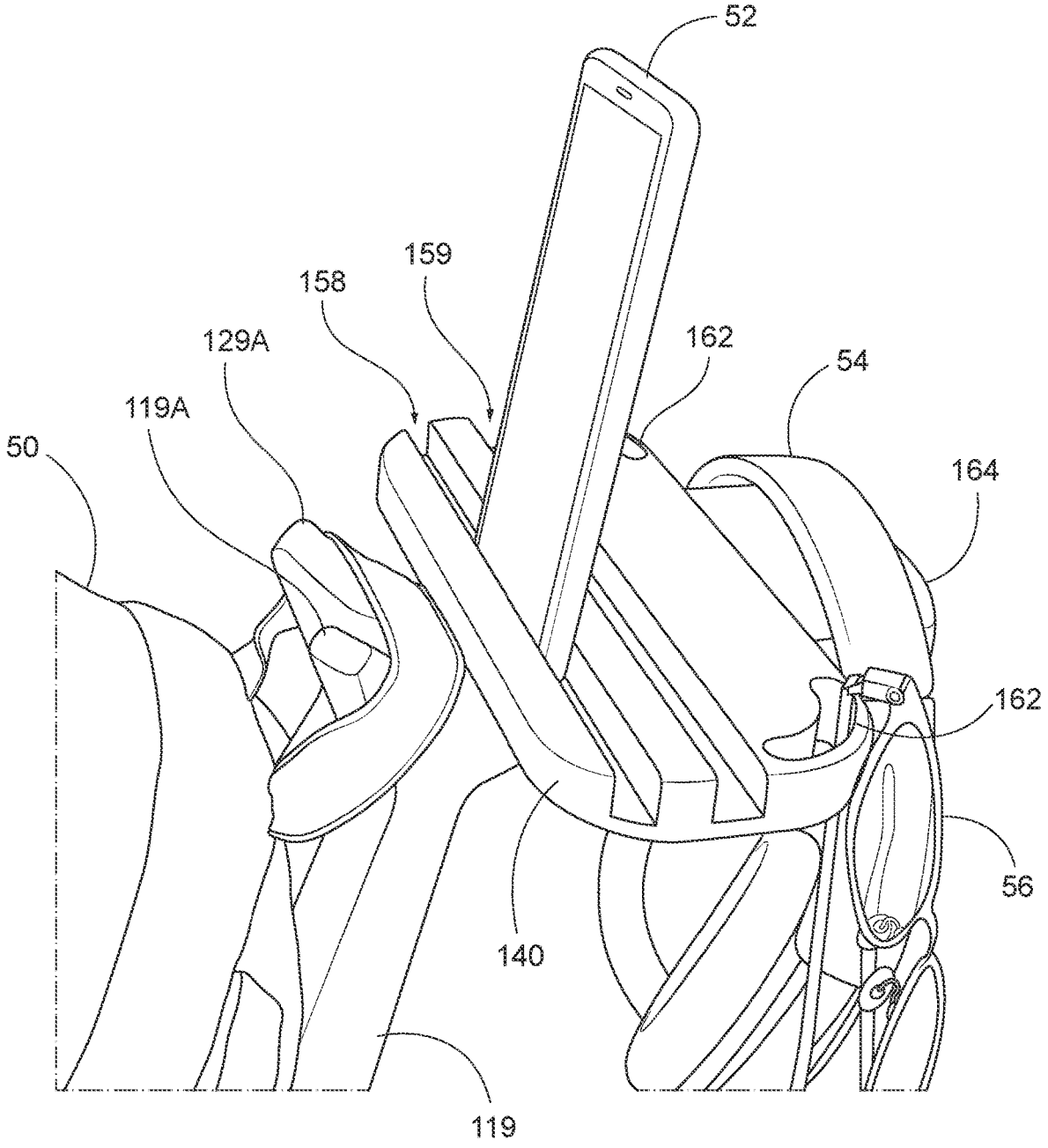
FIG. 11 is a perspective view of a top end of the structure of FIG. 1, supporting a bag, a phone, headphones and eyeglasses.

Through openings 162 in top platform 140 have a generally quarter-moon shape and can be used to hang personal objects such as reading glasses, sunglasses, keys, and/or carabiner clips. Top platform 140 has a generally oblong perimeter and an extension 164 extending outwardly from a longitudinal edge 166 of the top platform 140. Extension 164 has a lip 168 extending along a side of the extension 164 distal from the top platform 140. The features on top platform 140 provide a place for a user to support a bag, a tablet, a smartphone, headphones, charging cords, and the like. By way of example only, FIG. 11 shows support 100 supporting a bag 50, a phone 52, headphones 54, and eyeglasses 56.

In an exemplary embodiment, support 100 is formed of a plurality of components for ease of assembly and disassembly. In this way, support 100 can be quickly assembled, disassembled, nested, folded and/or opened for use or storage, nested in concert with one another, and the like. Support 100 can be accessible when needed but not take up space (which may be very valuable) when support 100 is not needed.

Support 100 can be utilized in homes, home offices, schools, workplaces, classrooms, public spaces, restaurants, coffee shops, plazas, conference rooms, assembly rooms, courtrooms, home offices, co-working spaces, co-working offices, and any other location where the device might be needed or utilized.

Support 100 can be constructed from wood, polymer resin, composite material, lightweight metal, or any other rigid material.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A freestanding support structure comprising:

a first leg member comprising:

a first base portion having a first free end having a first blind passage formed therein, the first free end extending along a first base axis and a connected end; and a first support portion extending upwardly from the connected end of the first base portion along a first support axis to a top end;

a second leg member comprising:

a second base portion having a second free end having a second blind passage formed therein, the second free end extending along a second base axis and a connected end; and a second support portion extending upwardly from the connected end of the second base portion along a second support axis to a top end;

a base platform connected to the free end of the first base portion and to the free end of the second base portion, a lower spacer block at least partially inserted into each of the first base portion 122 and the second base portion 124; and a top platform connected to the top end of the first support portion and to the top end of the second support portion, wherein the base platform has an "X-shaped" cutout, wherein the free end of the first base portion is inserted into a first leg of the "X" and wherein the free end of the second base potion is inserted into a remaining leg of the "X".

2. The freestanding support according to claim 1, wherein the first base axis extends obliquely relative to the first support axis.

3. The freestanding support according to claim 1, wherein the free end of the first base portion interlocks with the free end of the second base portion.

4. The freestanding support according to claim 1, wherein the top platform includes a "Y-shaped" cutout, wherein the top end of the first support portion is inserted into a first arm of the "Y" and wherein the top end of the second support portion is inserted into a remaining arm of the "Y".

5. The freestanding support according to claim 1, wherein the top end of each of the first support portion and the second support portion has a blind passage formed therein.

6. The freestanding support according to claim 5, further comprising a top spacer block having a first end inserted into the blind passage in the first support portion and a second end inserted into the blind passage of the second support portion.

7. The freestanding support according to claim 1, wherein the top end of the first support portion has a support slot formed therein.

8. The freestanding support according to claim 1, wherein the top platform has a plurality of through-openings formed therein.

9. The freestanding support according to claim 8, wherein the top platform has a first slot formed therein and a second slot, parallel to the first slot, formed therein such that at least some of the plurality of through-openings terminate in the first slot and wherein at least others of the plurality of through-openings terminate in the second slot.

10. The freestanding support according to claim 1, wherein the top platform has a generally oblong perimeter and an extension extending outwardly from a longitudinal edge of the top platform, wherein the extension extends co-planar with the top platform.

11. The freestanding support according to claim 10, wherein the extension has a lip extending along a side of the extension distal from the top platform.

12. The freestanding support according to claim 1, wherein the first support portion interlocks with the second support portion.

13. A freestanding support comprising:

a first support member having a first top end and a first base end, the first top end having a first cutout and a first blind passage formed therein;

a second support member having a second top end and a second base end, the second top end having a second cutout and a second blind passage formed therein, wherein the first top end and the second top end are interlocked with each other via the first and second cutouts and wherein the first base end and the second base end are interlocked with each other;

a base platform releasably connected to the first base end and the second base end;

a top platform releasably connected to the first top end and the second top end, the top platform having a "Y-shaped" cutout, wherein the top end of the first support portion is inserted into a first arm of the "Y" and wherein the top end of the second support potion is inserted into a remaining arm of the "Y", and an upper spacer block inserted into the blind passage in each of the first support portion and the second support portion.

14. The freestanding support according to claim 13, wherein each of the first support member and the second support member comprises a support portion extending between the respective top end and base end, wherein each support member comprises a forward floor pad.

15. The freestanding support according to claim 14, wherein each support portion extends at an oblique angle relative to its respective base end.

16. The freestanding support according to claim 13, wherein the top platform comprises a plurality of parallel slots formed in a top surface thereof.

17. The freestanding support according to claim 13, wherein the top platform is disposed vertically above the base platform.

* * * * *